US010362654B2

(12) United States Patent
Bong et al.

(10) Patent No.: US 10,362,654 B2
(45) Date of Patent: Jul. 23, 2019

(54) LIGHTING APPARATUS

(71) Applicant: SAMSUNG ELECTRONICS CO., LTD., Suwon-si, Gyeonggi-do (KR)

(72) Inventors: Sang Cheol Bong, Seoul (KR); Min Soo Han, Suwon-si (KR); Hyun Jung Kim, Yongin-si (KR); Kil Yoan Chung, Suwon-si (KR)

(73) Assignee: SAMSUNG ELECTRONICS CO., LTD., Suwon-si, Gyeonggi-do (KR)

( * ) Notice: Subject to any disclaimer, the term of this patent is extended or adjusted under 35 U.S.C. 154(b) by 0 days.

(21) Appl. No.: 16/168,009

(22) Filed: Oct. 23, 2018

(65) Prior Publication Data

US 2019/0082511 A1 Mar. 14, 2019

Related U.S. Application Data

(63) Continuation-in-part of application No. 15/941,085, filed on Mar. 30, 2018, now Pat. No. 10,123,386.

(30) Foreign Application Priority Data

Sep. 8, 2017 (KR) ..... 10-2017-0114964
Jul. 25, 2018 (KR) ..... 10-2018-0086709

(51) Int. Cl.
*H05B 33/08* (2006.01)

(52) U.S. Cl.
CPC ..... *H05B 33/0857* (2013.01); *H05B 33/0824* (2013.01)

(58) Field of Classification Search
CPC ..... H05B 33/0857; H05B 33/083; H05B 33/0809; H05B 33/0827; H05B 33/0848; H05B 33/0866; H05B 33/089; H05B 37/02; H05B 37/029; Y02B 20/347
See application file for complete search history.

(56) References Cited

U.S. PATENT DOCUMENTS 5,896,014 A * 4/1999 Ogawa ..... G03B 7/16 315/149
6,372,608 B1 4/2002 Shimoda et al.
6,495,964 B1 12/2002 Muthu et al.
6,645,830 B2 11/2003 Shimoda et al.
RE38,466 E 3/2004 Inoue et al.
6,818,465 B2 11/2004 Biwa et al.
6,818,530 B2 11/2004 Shimoda et al.
(Continued)

*Primary Examiner* — Haissa Philogene
(74) *Attorney, Agent, or Firm* — Lee & Morse, P.C.

(57) ABSTRACT

A lighting apparatus includes first and second light emitting areas, a color temperature controller, and a balance circuit. The first light emitting area includes first light-emitting arrays connected in series and outputs light of a first color temperature. The second light emitting area includes second light-emitting arrays connected in series and connected to the first light emitting area in parallel. The second light-emitting arrays output light of a second color temperature different from the first color temperature. The color temperature controller is selectively connected to at least one of an input node of the first light emitting area and an input node of the second light emitting area. The color temperature controllers determines an on/off state of the first and second light emitting areas. The balance circuit is connected to at least one of the first and second light emitting areas in series.

20 Claims, 15 Drawing Sheets

(56) References Cited

U.S. PATENT DOCUMENTS

| | | | |
|---|---|---|---|
| 6,858,081 | B2 | 2/2005 | Biwa et al. |
| 6,967,353 | B2 | 11/2005 | Suzuki et al. |
| 7,002,182 | B2 | 2/2006 | Okuyama et al. |
| 7,084,420 | B2 | 8/2006 | Kim et al. |
| 7,087,932 | B2 | 8/2006 | Okuyama et al. |
| 7,154,124 | B2 | 12/2006 | Han et al. |
| 7,208,725 | B2 | 4/2007 | Sherrer et al. |
| 7,288,758 | B2 | 10/2007 | Sherrer et al. |
| 7,319,044 | B2 | 1/2008 | Han et al. |
| 7,501,656 | B2 | 3/2009 | Han et al. |
| 7,709,857 | B2 | 5/2010 | Kim et al. |
| 7,759,140 | B2 | 7/2010 | Lee et al. |
| 7,781,727 | B2 | 8/2010 | Sherrer et al. |
| 7,790,482 | B2 | 9/2010 | Han et al. |
| 7,940,350 | B2 | 5/2011 | Jeong |
| 7,959,312 | B2 | 6/2011 | Yoo et al. |
| 7,964,881 | B2 | 6/2011 | Choi et al. |
| 7,985,976 | B2 | 7/2011 | Choi et al. |
| 7,994,525 | B2 | 8/2011 | Lee et al. |
| 8,008,683 | B2 | 8/2011 | Choi et al. |
| 8,013,352 | B2 | 9/2011 | Lee et al. |
| 8,049,161 | B2 | 11/2011 | Sherrer et al. |
| 8,129,711 | B2 | 3/2012 | Kang et al. |
| 8,179,938 | B2 | 5/2012 | Kim |
| 8,263,987 | B2 | 9/2012 | Choi et al. |
| 8,324,646 | B2 | 12/2012 | Lee et al. |
| 8,399,944 | B2 | 3/2013 | Kwak et al. |
| 8,432,511 | B2 | 4/2013 | Jeong |
| 8,459,832 | B2 | 6/2013 | Kim |
| 8,502,242 | B2 | 8/2013 | Kim |
| 8,536,604 | B2 | 9/2013 | Kwak et al. |
| 8,596,816 | B2 | 12/2013 | Atkins |
| 8,735,931 | B2 | 5/2014 | Han et al. |
| 8,766,295 | B2 | 7/2014 | Kim |
| 8,833,976 | B2 | 9/2014 | Chi |
| 9,559,150 | B2 | 1/2017 | Tischler et al. |
| 9,860,955 | B2 | 1/2018 | Kim et al. |
| 10,123,386 | B1 * | 11/2018 | Bong ..... H05B 33/0857 |
| 2010/0118527 | A1 | 5/2010 | Choong |
| 2013/0221861 | A1 | 8/2013 | Creusen et al. |
| 2014/0168965 | A1 | 6/2014 | Moon et al. |
| 2014/0333216 | A1 | 11/2014 | Zhang et al. |
| 2016/0002974 | A1 | 1/2016 | Boyle |
| 2017/0027030 | A1 | 1/2017 | Wang et al. |
| 2017/0027033 | A1 | 1/2017 | Chobot et al. |
| 2017/0030529 | A1 | 2/2017 | Bergmann et al. |

* cited by examiner

LIGHTING APPARATUS

CROSS-REFERENCE TO RELATED APPLICATION

This is a continuation-in-part application based on pending application Ser. No. 15/941,085, filed Mar. 30, 2018, the entire contents of which is hereby incorporated by reference.

Korean Patent Applications No. 10-2017-0114964 filed on Sep. 8, 2017 and No. 10-2018-0086709 filed on Jul. 25, 2018 in the Korean Intellectual Property Office are incorporated by reference herein in its entirety.

BACKGROUND

1. Field

One or more embodiments described herein relate to a lighting apparatus.

2. Description of Related Art

Semiconductor light emitting elements (such as light emitting diodes (LEDs)) have low power consumption, high luminance, and long life compared to other types of lighting elements. Some semiconductor light emitting elements output light of different color temperatures, and thus are suitable for use in lighting apparatuses. However, these types of semiconductor light emitting elements may experience various problems. For example, the brightness of light from generated from these elements may change or vary whenever a user makes an adjustment to color temperature.

SUMMARY

In accordance with one or more embodiments, a lighting apparatus includes a first light emitting area including a plurality of first light-emitting arrays connected in series, the first light-emitting arrays to output light of a first color temperature; a second light emitting area including a plurality of second light-emitting arrays connected in series and connected to the first light emitting area in parallel, the second light-emitting arrays to output light of a second color temperature different from the first color temperature; a color temperature controller to be selectively connected to at least one of an input node of the first light emitting area and an input node of the second light emitting area, the color temperature controller to determine an on/off state of the first light emitting area and the second light emitting area; and a balance circuit connected to at least one of the first light emitting area and the second light emitting area in series.

In accordance with one or more other embodiments, a lighting apparatus includes a substrate; a first light emitting area including a plurality of first LEDs mounted on the substrate; a second light emitting area including a plurality of second LEDs mounted on the substrate, the plurality of second LEDs to output light of a color temperature higher than that of the plurality of first LEDs; a color temperature controller including a user-operable switch, the color temperature controller to determine an on/off state of each of the first light emitting area and the second light emitting area by the switch; and a balance circuit connected between the second light emitting area and the color temperature controller.

In accordance with one or more other embodiments, a lighting apparatus includes a first light emitting area including a plurality of first LEDs to output light of a first color temperature, the first light emitting area including a first input node and a second input node; a second light emitting area including a plurality of second LEDs to output light of a second color temperature higher than the first color temperature, the second light emitting area including a third input node and a fourth input node; a power supply to input driving power to at least a portion of nodes among the first input node through the fourth input node; and a switch to connect at least a portion of nodes among the first input node through the fourth input node to each other and to adjust a color temperature of light output by the first and second light emitting areas.

BRIEF DESCRIPTION OF DRAWINGS

Features will become apparent to those of skill in the art by describing in detail exemplary embodiments with reference to the attached drawings in which.

DETAILED DESCRIPTION

Figure 1:
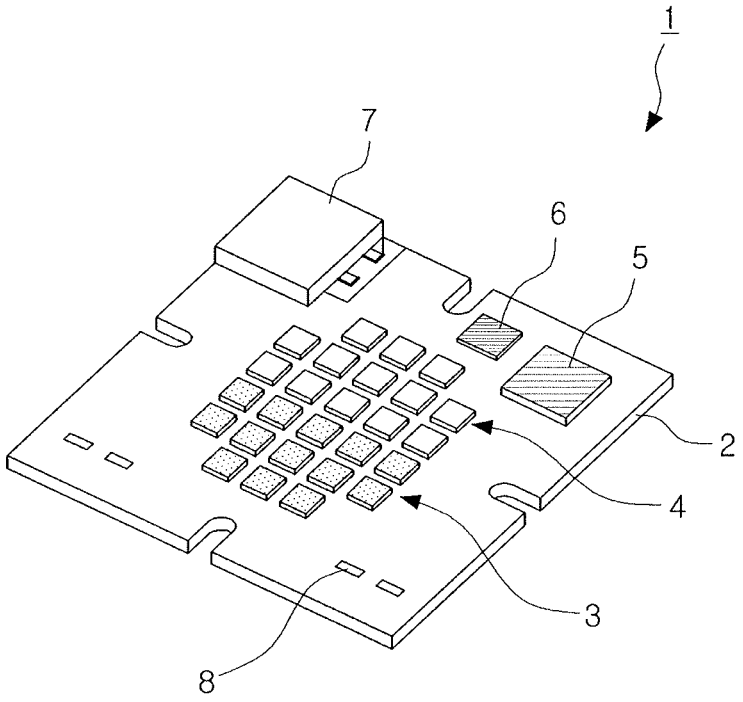
FIG. 1 illustrates an embodiment of a lighting apparatus.

FIG. 1 illustrates an embodiment of a lighting apparatus 1 which may include a substrate 2, a first light emitting area 3, a second light emitting area 4, driving circuit 5, a connector 7, and a terminal 8. The first light emitting area 3 may include a plurality of first LEDs mounted on the substrate 2. The second light emitting area 4 may include a plurality of second LEDs mounted on the substrate 2. The plurality of first LEDs and the plurality of second LEDs may output light of different color temperatures. In an example embodiment, the first LEDs may output light of a first color temperature, and the second LEDs may output light of a second color temperature higher than the first color temperature.

The first light emitting area 3 and the second light emitting area 4 may be operated by external power through the connector 7. In an example embodiment, commercial alternating current (AC) power may be input through the connector 7. A driving circuit 5 may include a power supply to supply driving power to the first light emitting area 3 and the second light emitting 4 using commercial AC power. In an example embodiment, a power supply may include a rectifier to rectify commercial AC power to generate driving power.

In one embodiment, the driving circuit 5 may include a driver to control an on/off state of a plurality of first LEDs and a plurality of second LEDs, with the power supply. For example, the driver may detect the magnitude of driving power and control the on/off state of the plurality of first LEDs and the plurality of second LEDs based on the detected magnitude of driving power. The lighting apparatus 1 may therefore be operated by receiving commercial AC power without a separate constant current converter circuit.

In an example embodiment, a color temperature controller 6 may adjust the color temperature of light output by the lighting apparatus 1. The color temperature controller 6 may adjust the color temperature of light output by the lighting apparatus 1 between a first color temperature (corresponding to the light output by the first light emitting area 3) and a second color temperature corresponding to the light output by the second light emitting area 4. In an example embodiment, when the first color temperature is 3,000 K and the second color temperature is 5,000 K, the color temperature of light output by the lighting apparatus 1 may be adjusted to be within a range of 3,000 K to 5,000 K by the color temperature controller 6. These values may be different in another embodiment.

The color temperature controller 6 may be connected to a mechanical switch or an electronic switch which a user is able to adjust or may be connected to another electronic device by wired/wireless communications. The user may operate the mechanical switch or the electronic switch to increase or decrease the color temperature. In one embodiment, an electronic device connected to enable communications with the color temperature controller 6 (e.g., an application on a mobile device) may be executed by a user, and the color temperature of light output by the lighting apparatus 1 may be adjusted in the application.

A terminal 8 may be included in the substrate 2 and connected to one or more additional circuit elements, e.g., a bypass capacitor, a filter, or another element. In one embodiment, the terminal 8 may be connected to a circuit pattern inside the substrate 2 and/or in an upper surface and a lower surface of the substrate 2.

Figure 2:
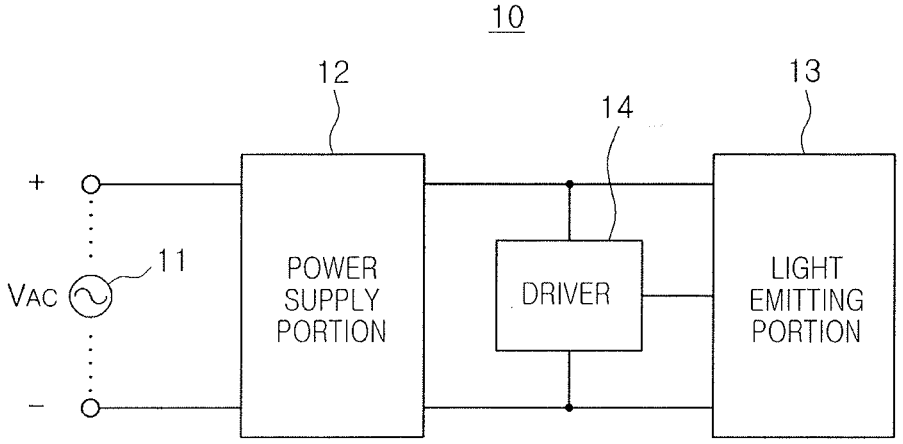
FIG. 2 illustrates another type of a lighting apparatus.

FIG. 2 illustrates another type of lighting apparatus 10 which may include a power supply 12 to receive commercial AC power 11 and generate driving power, a light emitting area 13 having a plurality of LEDs, and a driver 14. The lighting apparatus 10 may not have a color temperature adjusting function, and a plurality of LEDs in the light emitting area 13 may operate simultaneously.

Figure 3:
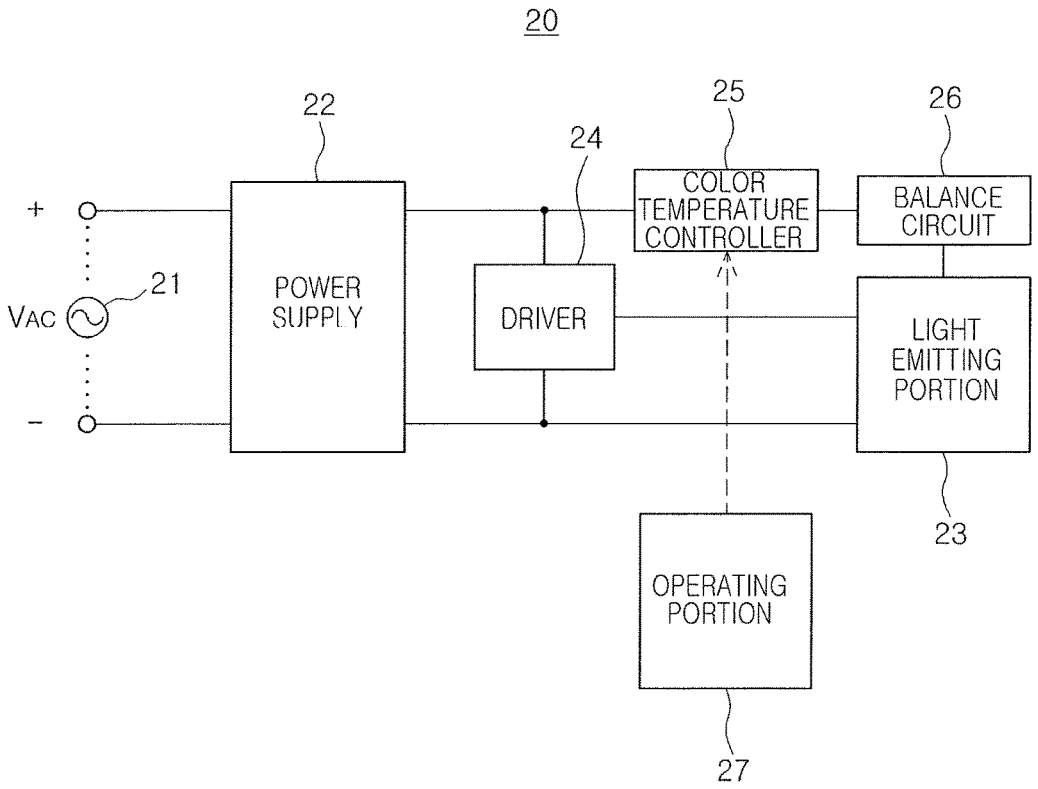
FIG. 3 illustrates another embodiment of a lighting apparatus.

FIG. 3 illustrates another embodiment of a lighting apparatus 20 which may include a power supply 22 to receive commercial AC power 21 and generate driving power, a light emitting area 23 having a plurality of LEDs, a driver 24, and a color temperature controller 25. The light emitting area 23 may include a first light emitting area having a plurality of first LEDs to output light of a first color temperature and a second light emitting area having a plurality of second LEDs to output light of a second color temperature different from the first color temperature. The first light emitting area and the second light emitting area may be connected to each other in parallel.

The driver 24 detects the magnitude of driving power output by the power supply 22 and adjusts the number of LEDs which have been turned-on in each of the first light emitting area and the second light emitting area. The color temperature controller 25 may include a switch element to selectively apply driving power to at least one of an input node of the first light emitting area and an input node of the second light emitting area. The first light emitting area and the second light emitting area may be turned on simultaneously, or only one of the first light emitting area and the second light emitting area are turned on, based on operation of a switch in the color temperature controller 25.

An operating controller 27 may control operation of a switch in the color temperature controller 25. In an example embodiment, the operating controller 27 may be a mechanical or electronic operating device connected to the color temperature controller 25. When a user operates an operating device of the operating controller 27, the color temperature of light output by the lighting apparatus 20 may be changed by a switch in the color temperature controller 25. Thus, different from the lighting apparatus 10 of FIG. 2, a user may intentionally change the color temperature of light.

A balance circuit 26 may be between the color temperature controller 25 and the light emitting area 23. The balance circuit 26 may include a resistor, a diode, and/or another element connected to only one of the first light emitting area and the second light emitting area in series or connected to the first light emitting area and the second light emitting area in series. The balance circuit 26 may the color temperature, brightness, and/or another parameter of light output by the light emitting region 23 to be finely adjusted.

Figure 4:
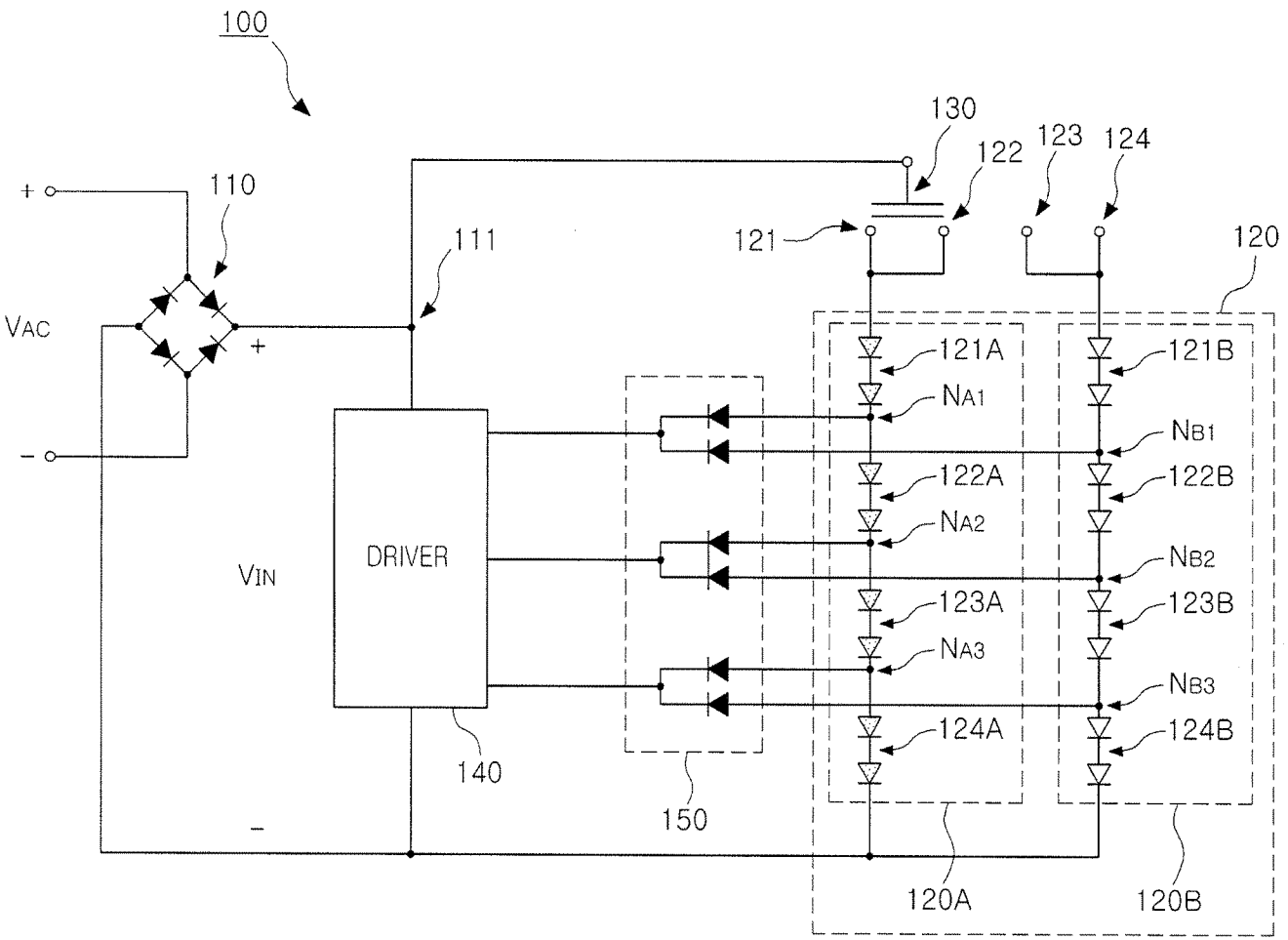
FIG. 4 illustrates a circuit embodiment of a lighting apparatus.

FIG. 4 illustrates a circuit embodiment of a lighting apparatus 100 which may include a power supply 110, a light emitting area 120, a color temperature controller 130, and a driver 140. The power supply 110 may receive AC power VAC and generate driving power VIN. The light emitting area 120 may include a first light emitting area 120A and a second light emitting area 120B that receive the driving power VIN. The first light emitting area 120A may include a plurality of first light-emitting arrays 121A to 124A, and the second light emitting area 120B may include a plurality of second light-emitting arrays 121B to 124B.

In the example embodiment of FIG. 4, operation of the first light-emitting arrays 121A to 124A and the second light-emitting arrays 121B to 124B may be controlled by the driver 140. For example, the driver 140 may detect the magnitude of the driving power VIN and control the on/off state of LEDs in the first light-emitting arrays 121A to 124A and the LEDs in the second light-emitting arrays 121B to 124B, to thereby driving the light emitting area 120. An example of the operation of the driver 140 is provided with reference to FIG. 5.

In an example embodiment of FIG. 4, input nodes 121 to 124 of the first light emitting area 120A and the second light emitting area 120B may be selectively connected to an output node 111 of the driving power VIN by the color temperature controller 130. The color temperature controller 130 of FIG. 4 may include a switch element, and at least one of the first light emitting area 120A and the second light emitting area 120B may receive the driving power VIN by the color temperature controller 130 for operation.

As described above, the first light emitting area 120A may output light of a first color temperature and the second light emitting area 120B may output light of a second color temperature different from the first color temperature. Thus, according to operation of the color temperature controller 130, the color temperature of light output by the light emitting area 120 may be determined to be between a first color temperature and a second color temperature.

In an example embodiment, an operating device for controlling the color temperature controller 130 may be provided to a user. The operating device may include, for example, a jog shuttle, a sliding switch, a button, and or another device. The user controls the color temperature controller 130 using the operating device in order to set the color temperature of light output by the lighting apparatus 100 to a desired value.

A block of diodes 150 may be between the driver 140 and the light emitting area 120. The block of diodes 150 may be connected to nodes NA1 to NA3 between first light-emitting arrays 121A to 124A and to nodes NB1-NB3 between second light-emitting arrays 121B to 124B. The block of diodes may operate to block current so that the current flows from the driver 140 to the light emitting area 120.

Figure 5:
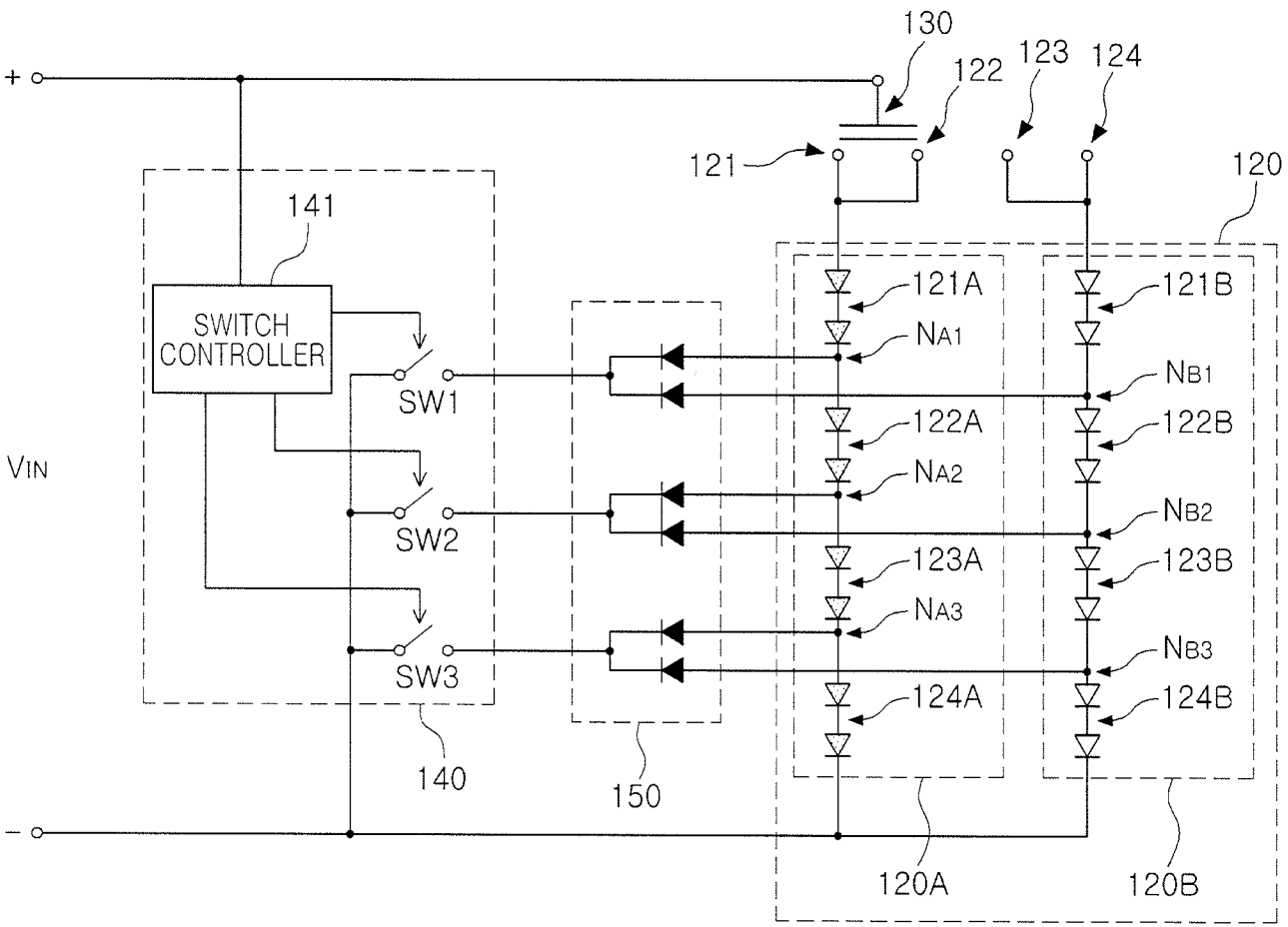
FIG. 5 illustrates another embodiment of a lighting apparatus.

FIG. 5 illustrates another circuit embodiment of a lighting apparatus in which the driver 140 includes a switch controller 141 and a plurality of internal switches SW1 to SW3. In an example embodiment, the plurality of internal switches SW1 to SW3 may be connected to nodes NA1 to NA3 between first light-emitting arrays 121A to 124A and to nodes NB1 to NB3 between second light-emitting arrays 121B to 124B through the block of diodes 150, respectively. For example, a first internal switch SW1 may be connected to first nodes NA1 and NB1 through a first block of diode pairs DA1 and DB1. A second internal switch SW2 may be connected to second nodes NA2 and NB2 through a second block of diode pairs DA2 and DB2. A third internal switch SW3 may be connected to third nodes NA3 and NB3 through a third block of diode pairs DA3 and DB3.

The switch controller 141 may control operation of the plurality of internal switches SW1 to SW3, according to the magnitude of the voltage of the driving power VIN, to determine a path in which current flows in the light emitting area 120. The driving power VIN may have a voltage waveform generated by full-wave rectifying AC power. The switch controller 141 may adjust the number of light-emitting arrays 121A to 124A and 121B to 124B receiving the driving power VIN based on the magnitude of the voltage change in the driving power VIN. An example will be described with reference to FIG. 6.

Figure 6:
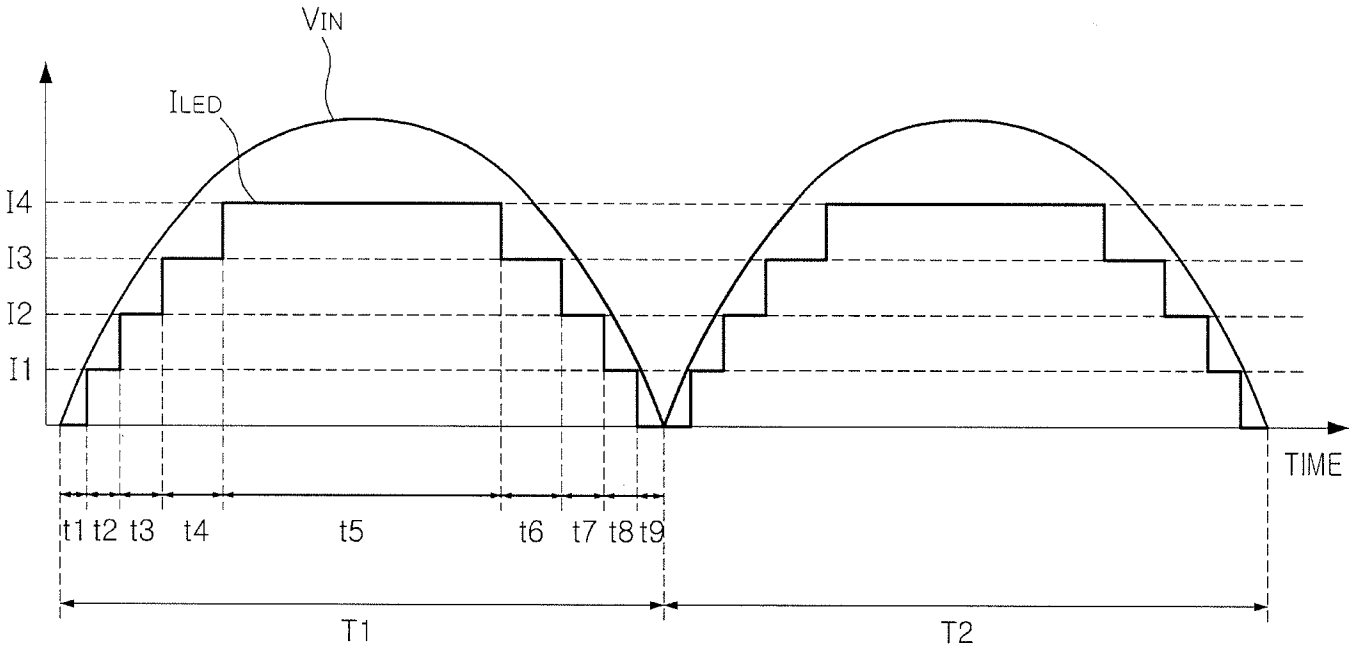
FIG. 6 illustrates an embodiment for operating a lighting apparatus.

FIG. 6 illustrates a graph corresponding to an operation of a lighting apparatus. Referring to FIG. 6, driving power VIN input to the light emitting area 120 may have a waveform that is repeated every predetermined period. In an example embodiment, the driving power VIN is generated by full-wave rectifying commercial AC power at 220V-60 Hz, and thus may have a peak voltage at 220 V and a frequency at 120 Hz.

In one cycle T1, the driving power VIN may be divided into a predetermined number (e.g., nine) sections, t1 to t9. In a first section t1 and a ninth section t9, the magnitude of voltage of the driving power VIN is relatively small, so a voltage sufficient for operating the light emitting area 120 may not be supplied. Thus, in the first section t1 and the ninth section t9, the light emitting area 120 may not be turned on.

In a second section t2 and an eighth section t8, current I1 may be supplied to the light emitting area 120 by the driving power VIN. In the second section t2 and the eighth section t8, voltage of the driving power YIN is sufficient to drive primary light-emitting arrays 121A and 121B, but may be insufficient to drive the primary light emitting arrays 121A and 121B as well as secondary light emitting arrays 122A and 122B together. Thus, the switch controller 141 only allows a first internal switch SW1, among the plurality of internal switches SW1 to SW3, to be turned on, and thus may set current I1 to flow through the primary light-emitting arrays 121A and 121B, first block diode pairs DA1 and DB1, and the first internal switch SW1. Thus, in the second section t2 and the eighth section t8, only the primary light-emitting arrays 121A and 121B are operated. The remaining light-emitting arrays 122A to 124A and 122B to 124B may not be operated.

In a third section t3 and a seventh section t7, voltage of the driving power VIN may be a voltage sufficient to drive the primary light-emitting arrays 121A and 121B as well as the secondary light-emitting arrays 122A and 122B. Thus, in the third section t3 and the seventh section t7, the switch controller 141 may only allow the second internal switch SW2 to be turned on and may allow remaining internal switches SW1 and SW3 to be turned off. Finally, in the third section t3 and the seventh section t7, a path of current I2 applied to the light emitting area 120 may be defined as a path, passing through the primary light-emitting arrays 121A and 121B as well as the secondary light-emitting arrays 122A and 122B, second block diode pairs DA2 and DB2, and the second internal switch SW2. Thus, in the third section t3 and the seventh section t7, only the primary light-emitting arrays 121A and 121B as well as the secondary light-emitting arrays 122A and 122B may be turned on.

Similarly, in a fourth section t4 and a sixth section t6, voltage of the driving power VIN may be sufficient to drive the primary light-emitting arrays 121A and 121B to tertiary light-emitting arrays 123A and 123B. However, in the fourth section t4 and the sixth section t6, voltage of the driving power VIN may be insufficient to drive all light-emitting arrays 121A to 124A and 121B to 124B. Thus, in the fourth section t4 and the sixth section t6, the switch controller 141 allows only the third internal switch SW3 to be turned on, and thus may control current I3 to flow through only the primary light-emitting arrays 121A and 121B to the tertiary light-emitting arrays 123A and 123B.

In a fifth section t5, voltage of the driving power VIN may have a magnitude sufficient to drive all light-emitting arrays 121A to 124A and 121B to 124B. Thus, in the fifth section t5, the switch controller 141 allows all internal switches SW1 to SW3 to be turned-off, and thus may set all light-emitting arrays 121A to 124A and 121B to 124B to be operated by current I4.

As described previously, during at least a portion of one cycle of the driving power VIN, current ILED flowing in the light emitting area 120 may flow toward an interior of the driver 140. In an example embodiment, the block of diodes 150 is between the driver 140 and the light emitting area 120, and thus may prevent current ILED from flowing from the driver 140 to the light emitting area 120.

Figure 7:
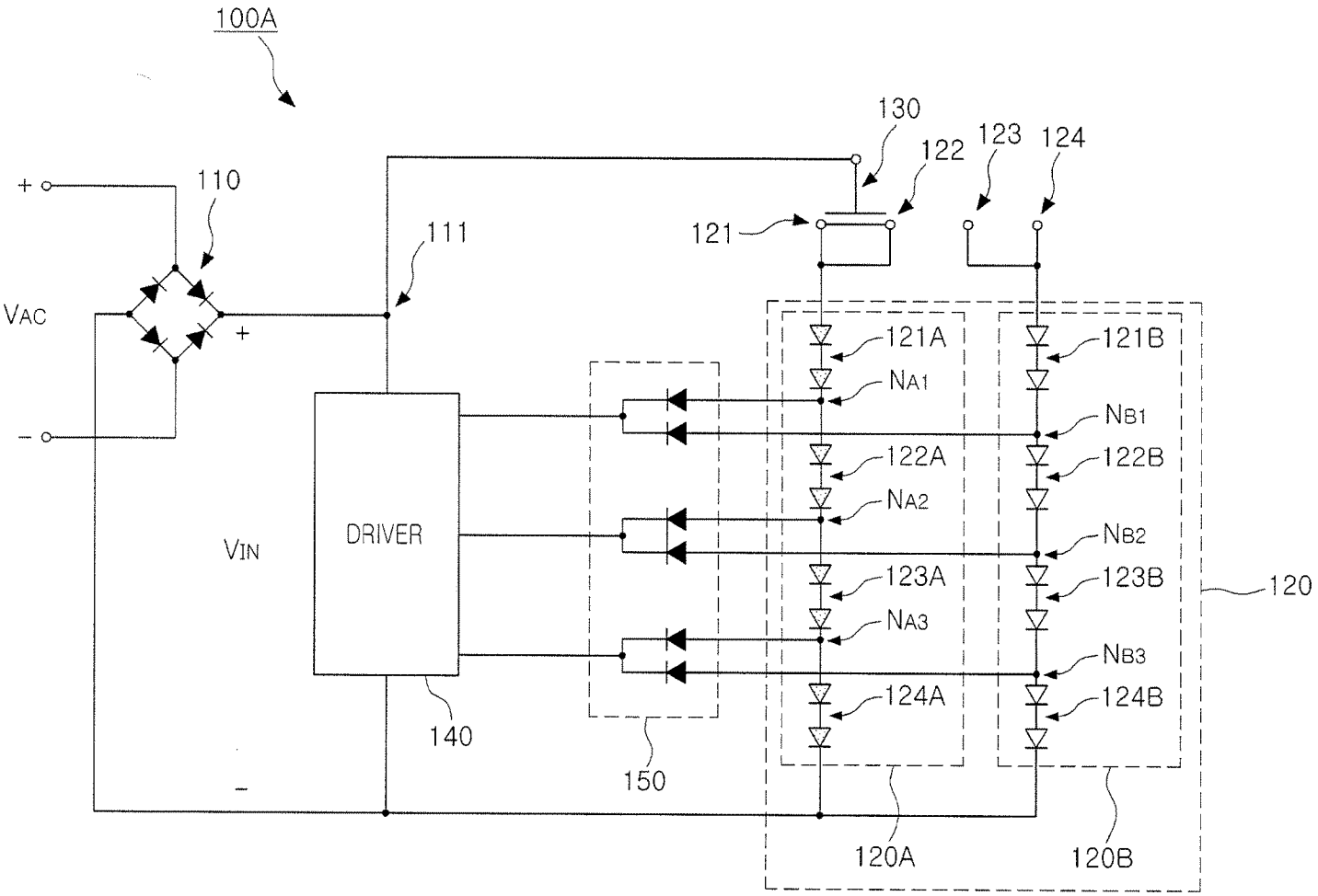
FIGS. 7 to 9 illustrate additional circuit embodiments of a lighting apparatus.
Figure 8:
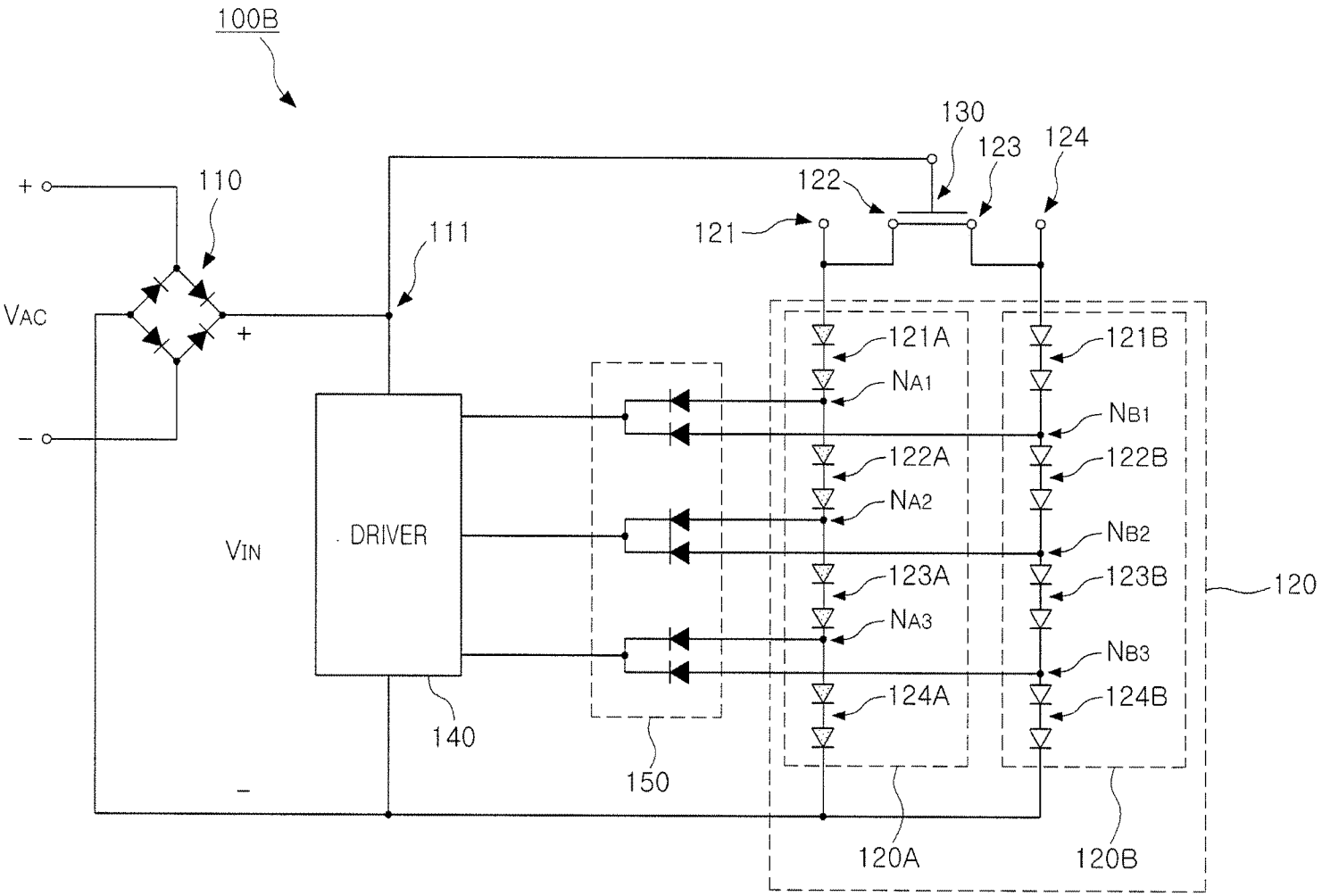
Figure 9:
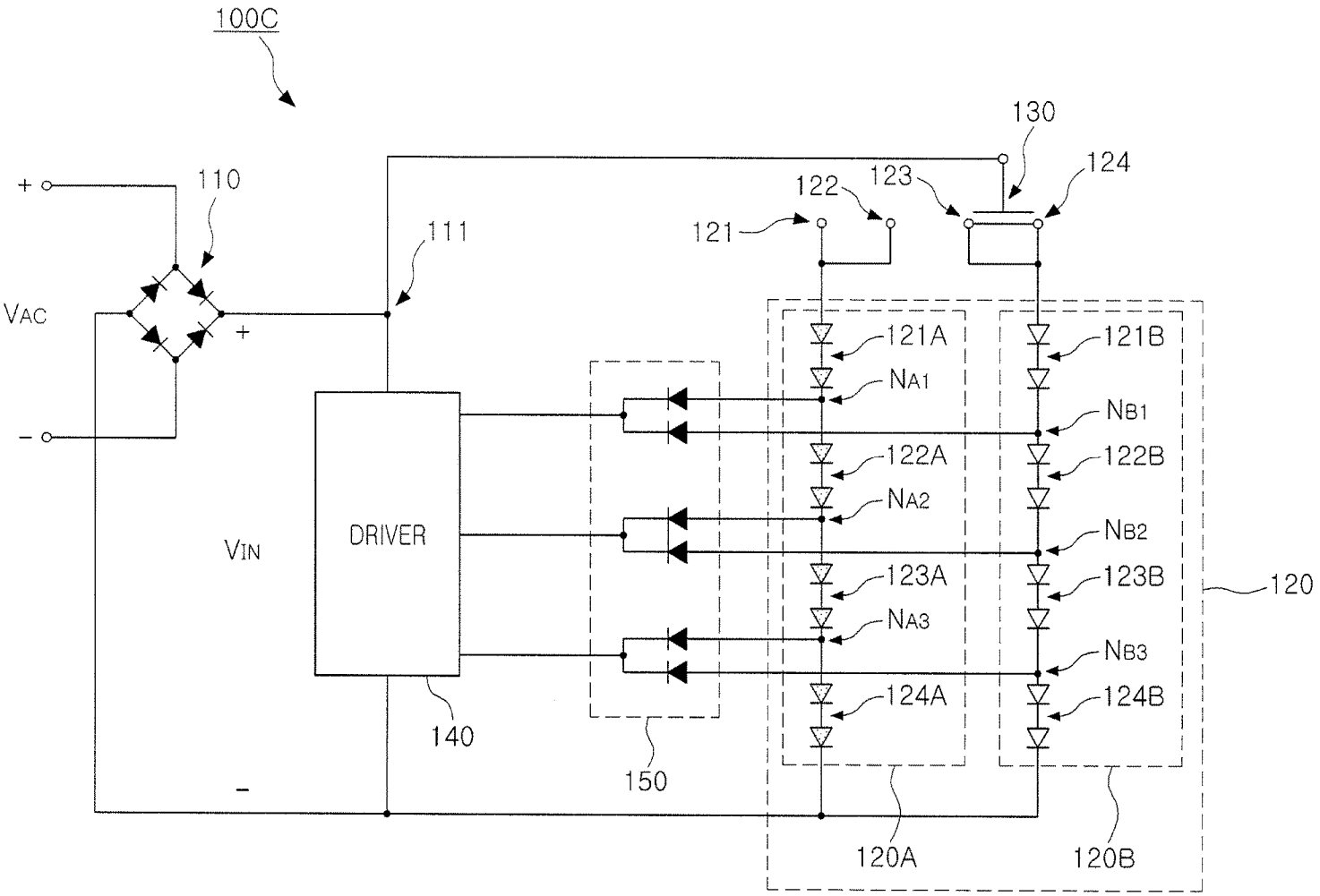

FIGS. 7 to 9 illustrate additional circuit embodiments for operating a lighting apparatus. In example embodiments illustrated in FIGS. 7 through 9, a light emitting area 120 may include a first light emitting area 120A and a second light emitting area 120B, the first light emitting area 120A outputs light having a first color temperature, and the second light emitting area 120B outputs light having a second color temperature. The second color temperature may be higher than the first color temperature. For example, when the first light emitting area 120A and the second light emitting area 120B output white light, the first light emitting area 120A may be a warm white light source and the second light emitting area 120B may be a cool white light source.

First, in the example embodiment of FIG. 7, the color temperature controller 130 may allow the first input node 121 and the second input node 122 of the first light emitting area 120A to be connected to the output node 111 of the power supply area 110. In addition, a third input node 123 and a fourth input node 124 of the second light emitting area 120B may be separated from the output node 111 of the power supply area 110. Thus, only the first light emitting area 120A receives the driving power VIN to be operated. In this case, operation of the first light emitting area 120A may be similar to that described with reference to FIGS. 5 and 6. Thus, in the example embodiment of FIG. 7, a lighting apparatus 100A may output light having a first color temperature.

Next, referring to FIG. 8, the color temperature controller 130 may allow the second input node 122 of the first light emitting area 120A and the third input node 123 of the second light emitting area 120B to be connected to the output node 111 of the power supply 110. In addition, the first input node 121 of the first light emitting area 120A and the fourth input node 124 of the second light emitting area 120B may be separated from the output node 111 of the power supply 110. Thus, in the example embodiment of FIG. 8, the first light emitting area 120A and the second light emitting area 120B of a lighting apparatus 100B may be turned on. As a result, light output by the lighting apparatus 100B may have a color temperature higher than a first color temperature and lower than a second color temperature.

Referring to FIG. 9, the color temperature controller 130 may allow the third input node 123 and the fourth input node 124 of the second light emitting area 120B to be connected to the output node 111 of the power supply 110. Simultaneously, the first input node 121 and the second input node 122 of the first light emitting area 120A may be separated from the output node 111 of the power supply 110. In the example embodiment of FIG. 9, only the second light emitting area 120B of a lighting apparatus 100C is turned on and light having a second color temperature may be output.

In example embodiments of FIGS. 7 to 9, a node or nodes, among the first input node 121 to the fourth input node 124, to be connected to the output node 111 of the power supply 110 using the color temperature controller 130 may be determined by a user. The color temperature controller 130 may be implemented as a switch element. An operating device to operate or control a connection state of the color temperature controller 130 may be provided to a user. The operating device may be implemented in various methods, including but not limited to a sliding switch, a button, a touch screen, an application on a mobile device, or a jog shuttle. A user operates the color temperature controller 130 using the operating device, so a color temperature of light output by the light emitting area 120 may be adjusted between a first color temperature and a second color temperature.

FIGS. 10 to 15 illustrate additional circuit diagrams of a lighting apparatus. In the example embodiments of FIGS. 10 to 15, a light emitting area 220 may receive driving power VIN generated by a power supply 210 to be operated. The light emitting area 220 may include a first light emitting area 220A having a plurality of LEDs that output light of a first color temperature and a second light emitting area 220B having a plurality of LEDs that output light of a second color temperature. In an example embodiment, the second color temperature may be higher than the first color temperature, the first light emitting area 220A may be a warm white light source, and the second light emitting area 220B may be a cool white light source.

The first light emitting area 220A may be connected to a first input node 221 and a second input node 222. The second light emitting area 220B may be connected to a third input node 223 and a fourth input node 224. At least a portion among the first through input nodes 221 to 224 may be connected to an output node 211 of the power supply 210 by a color temperature controller 230. The color temperature controller 230 may be implemented, for example, as a switch element and at least one of the first light emitting area 220A and the second light emitting area 220B may receive the driving power VIN to be operated by the color temperature controller 230. Thus, a user may adjust the color temperature of light output by the light emitting area 220 between the first color temperature and the second color temperature using the color temperature controller 230.

The lighting apparatuses 200A, 200B, 200C, 200D, 200E, and 200F of FIGS. 10 to 15 may include balance circuits 260A, 260B, 260C, 260D, 260E, and 260F, respectively. The balance circuits 260A, 260B, 260C, 260D, 260E, and 260F may include a resistor, a diode, a light emitting diode, or another circuit.

Figure 10:
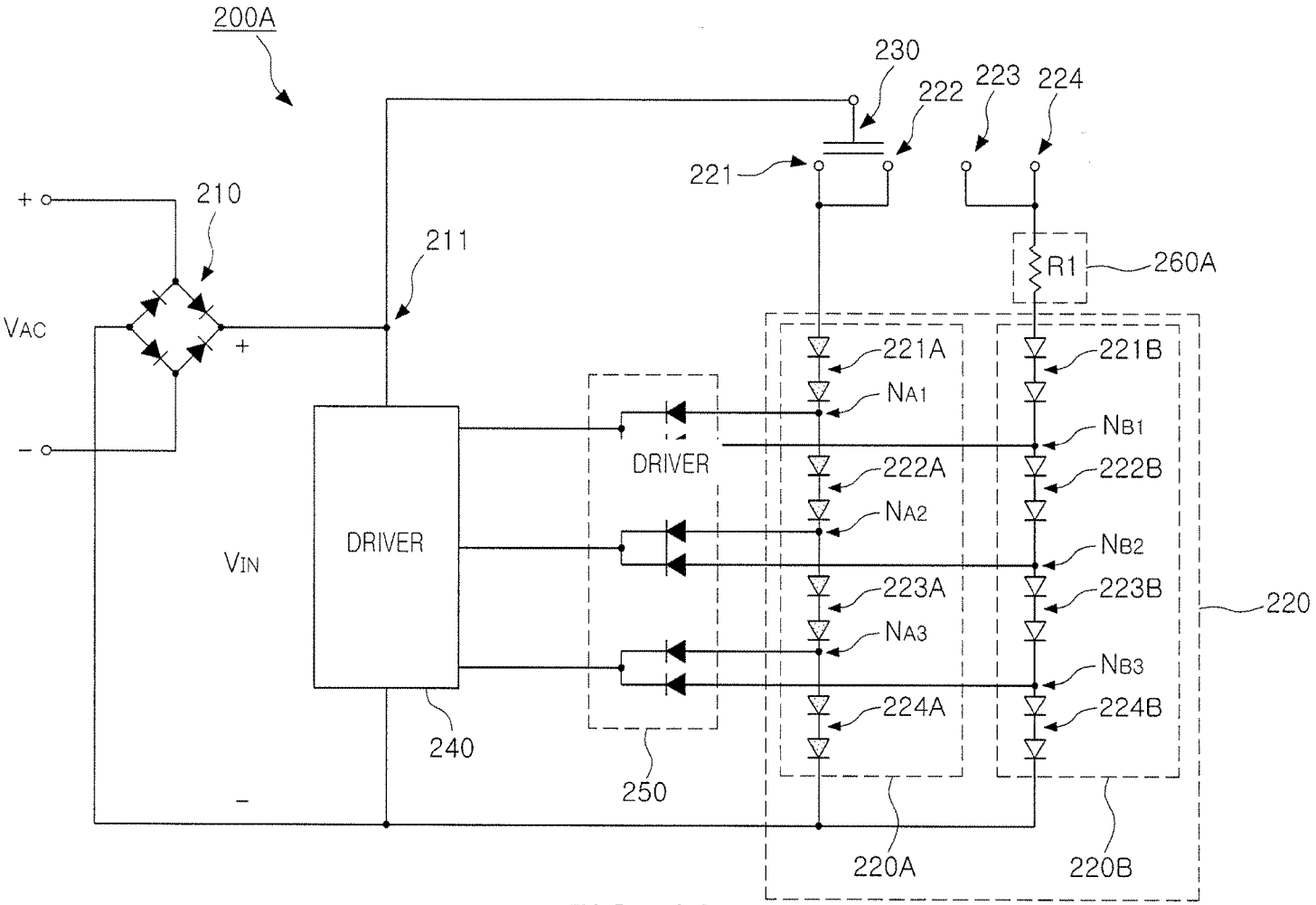
FIGS. 10 to 15 illustrate more circuit embodiments of a lighting apparatus.

First, referring to FIG. 10, a lighting apparatus 200A may include a balance circuit 260A. The balance circuit 260A may include a resistor R1 and may only be connected to the second light emitting area 220B.

When the color temperature controller 230 is connected to the first input node 221 and the second input node 222, only the first light emitting area 220A is turned on. As a result, light having a first color temperature may be output. When the color temperature controller 230 is connected to the third input node 223 and the fourth input node 224, only the second light emitting area 220B is turned on. As a result, light having a second color temperature may be output. When a user operates the color temperature controller 230 and a color temperature of light output by the light emitting area 220 is changed, then, in one embodiment, only the color temperature of light is changed while brightness of the light is maintained to be constant, if possible.

In another type of device which has been proposed, assuming that the same amount of current is applied compared to LEDs outputting warm white light, LEDs outputting cool white light may output brighter light. Thus, in an example embodiment of FIG. 10, in order to significantly reduce brightness deviations of the light emitting area 220 due to an operation of the color temperature controller 230, the balance circuit 260A may be connected to only the second light emitting area 220B outputting cool white light. Voltage applied to LEDs in the second light emitting area 220B may be reduced by the balance circuit 260A, so brightness deviation of the first light emitting area 220A and the second light emitting area 220B may be significantly reduced.

Figure 11:
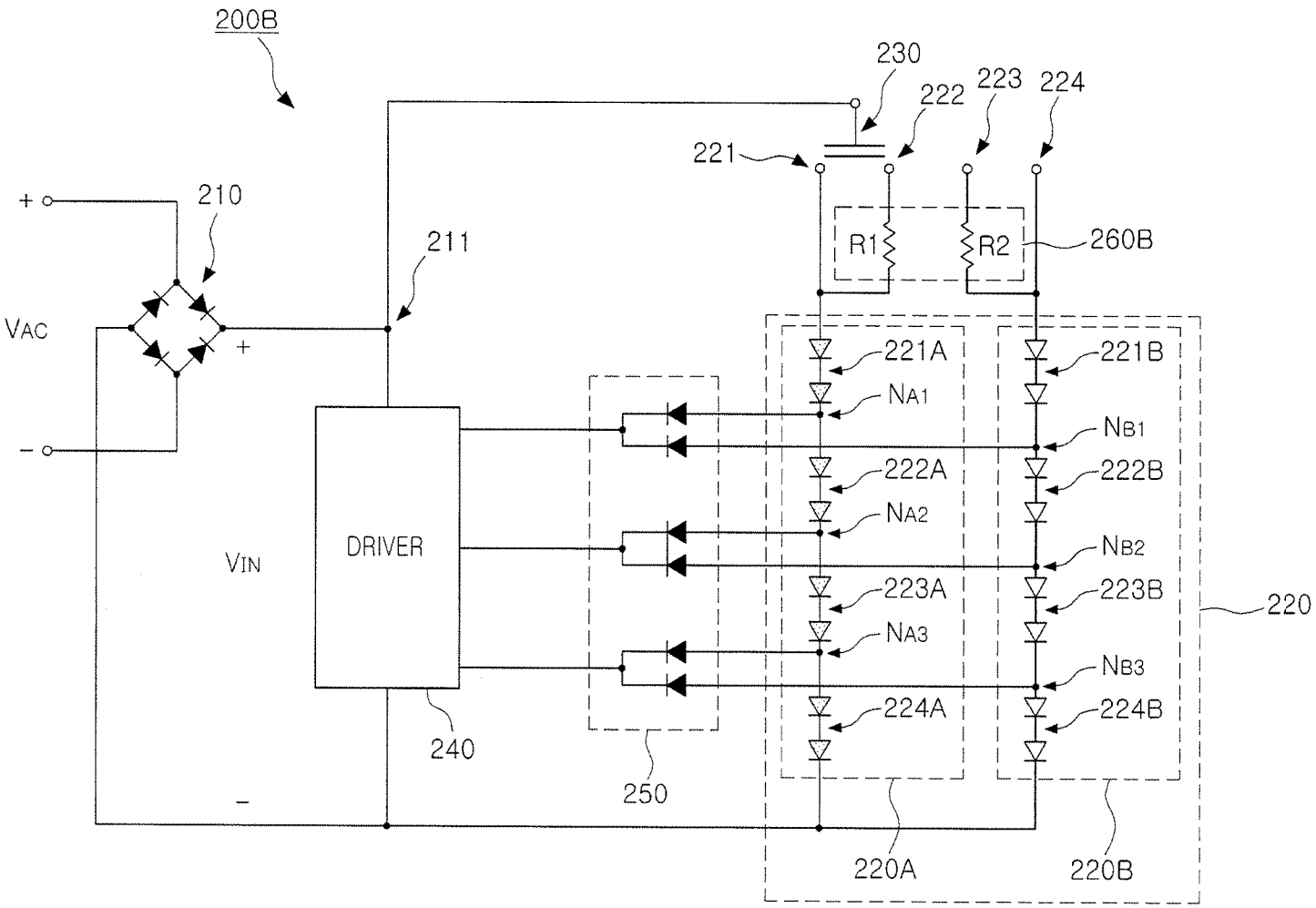

Next, referring to FIG. 11, a balance circuit 260B may include a first resistor R1 and a second resistor R2. The first resistor R1 may be connected between the second input node 222 and the first light emitting area 220A. The second resistor R2 may be connected between the third input node 223 and the second light emitting area 220B.

In an example embodiment of FIG. 11, when a user desires to obtain light having a color temperature corresponding to a median value between a first color temperature and a second color temperature, light having the color temperature which the user desires may be accurately provided. As the user desires the color temperature controller 230 to allow the output node 211 of the power supply 210 to be connected to the second input node 222 and the third input node 223, light having a color temperature corresponding to a median value between a first color temperature and a second color temperature may be obtained. When the first light emitting area 220A and the second light emitting area 220B are turned on simultaneously, each of the first resistor R1 and the second resistor R2 may be selected to have a value allowing each of the first light emitting area 220A and the second light emitting area 220B to output light having almost the same brightness.

Figure 12:
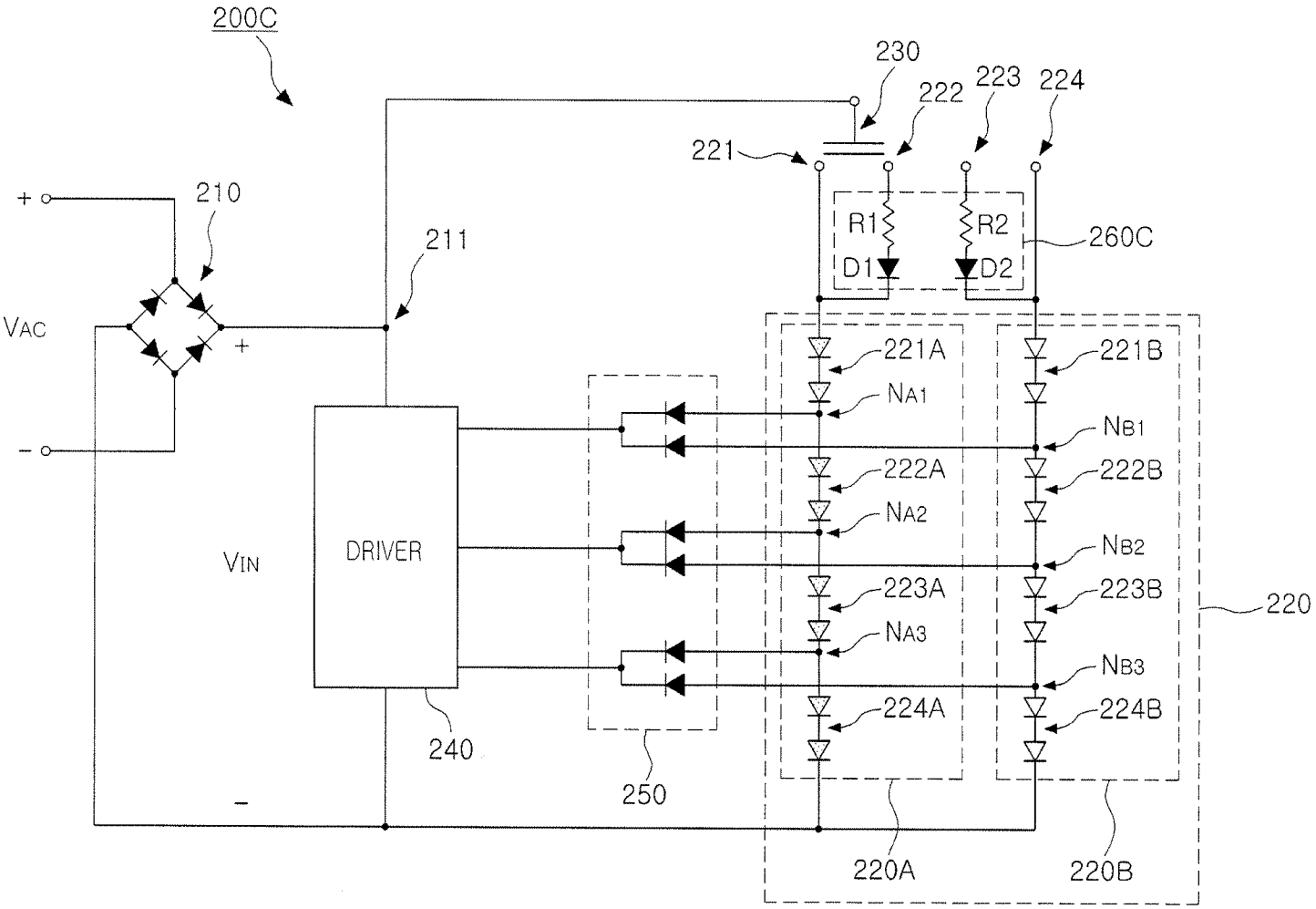

Next, referring to FIG. 12, a balance circuit 260C may include a first resistor R1, a second resistor R2, a first diode D1, and a second diode D2. The first resistor R1 and the first diode D1 may be connected to each other in series and may be connected between the second input node 222 and the first light emitting area 220A. The second resistor R2 and the second diode D2 may be connected to each other in series and may be connected between the third input node 223 and the second light emitting area 220B. When the color temperature controller 230 is connected to the second input node 222 and the third input node 223, elements R1, R2, D1, and D2 in the balance circuit 260C may set the color temperature of light output by the light emitting area 220 to have a median value between a first color temperature and a second color temperature.

Figure 13:
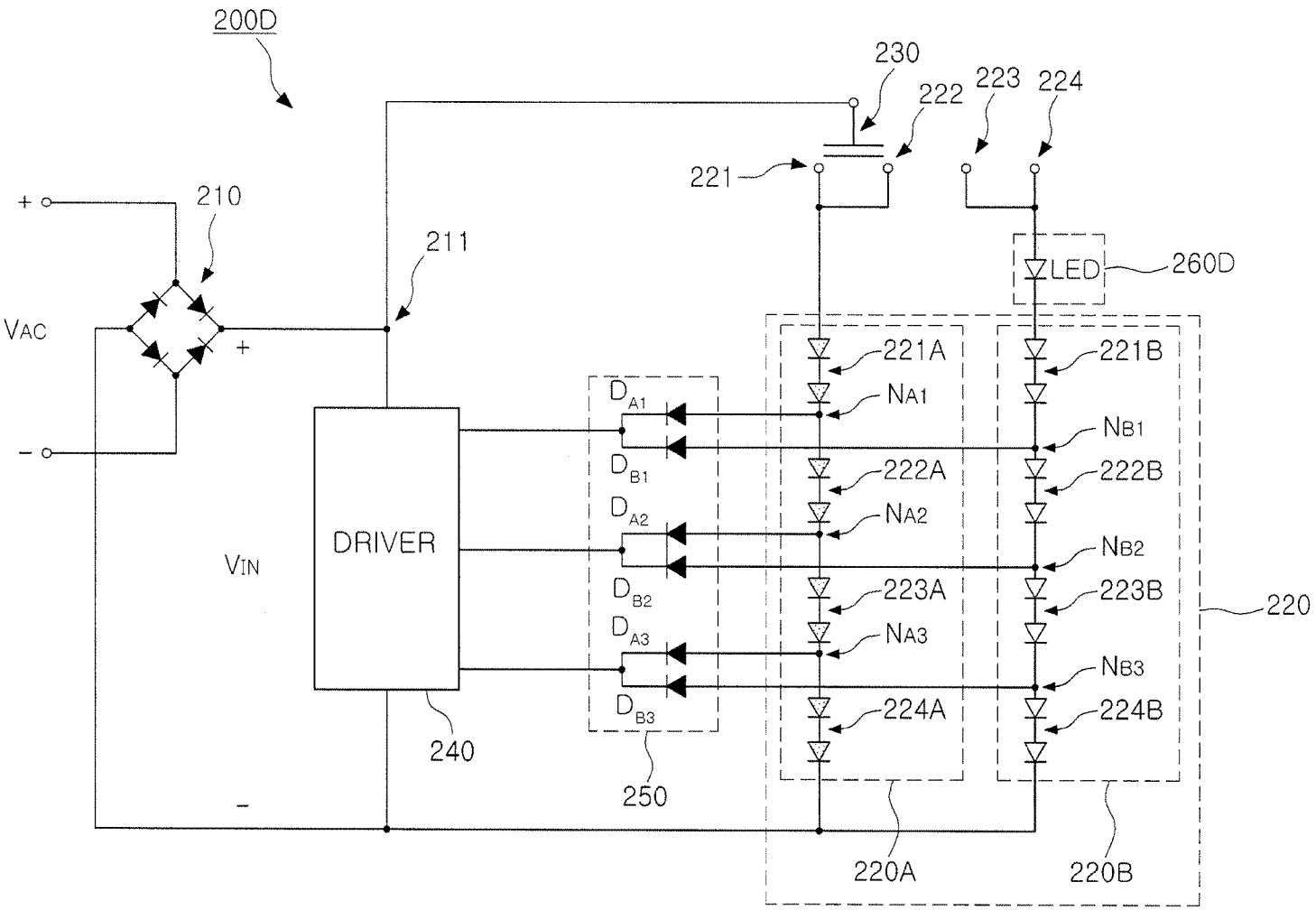

In an example embodiment of FIG. 13, a balance circuit 260D may include a light emitting diode LED, and the light emitting diode LED may be connected only to the second light emitting area 220B. As described above, the color temperature controller 230 may turn on only the first light emitting area 220A, or turn on only the second light emitting area 220B, or turn on both of the first light emitting area 220A and the second light emitting area 220B. When the user adjust a color temperature of light emitted by the light emitting area 220, only the color temperature of light is changed while brightness of the light is maintained to be constant, if possible.

In an example embodiment, assuming that the same amount of voltage/current is applied to the light emitting area 220 while the color temperature of light is changed, cool white light emitted by the second light emitting area 220B is brighter than warm white light emitted by the first light emitting area 220A. In an example embodiment of FIG. 13, in order to reduce brightness deviation while the color temperature of light is changed, the light emitting diode LED may be connected to the second light emitting area 220B, as the balance circuit 260D. The light emitting diode LED may output cool white light, similar with the second light emitting area 220B. Forward voltage applied to each of a plurality of LEDs included in the second light emitting area 220B may be decreased, by connecting the light emitting diode LED, thus, brightness deviation caused by changing color temperature can be decreased. Also, a size of the balance circuit 260D can be reduced in comparison with a balance circuit using an element such as a resistor, and an efficiency of the lighting apparatus 200D can be improved. In an example embodiment, the balance circuit 260D may include a plurality of light emitting diodes LED.

Figure 14:
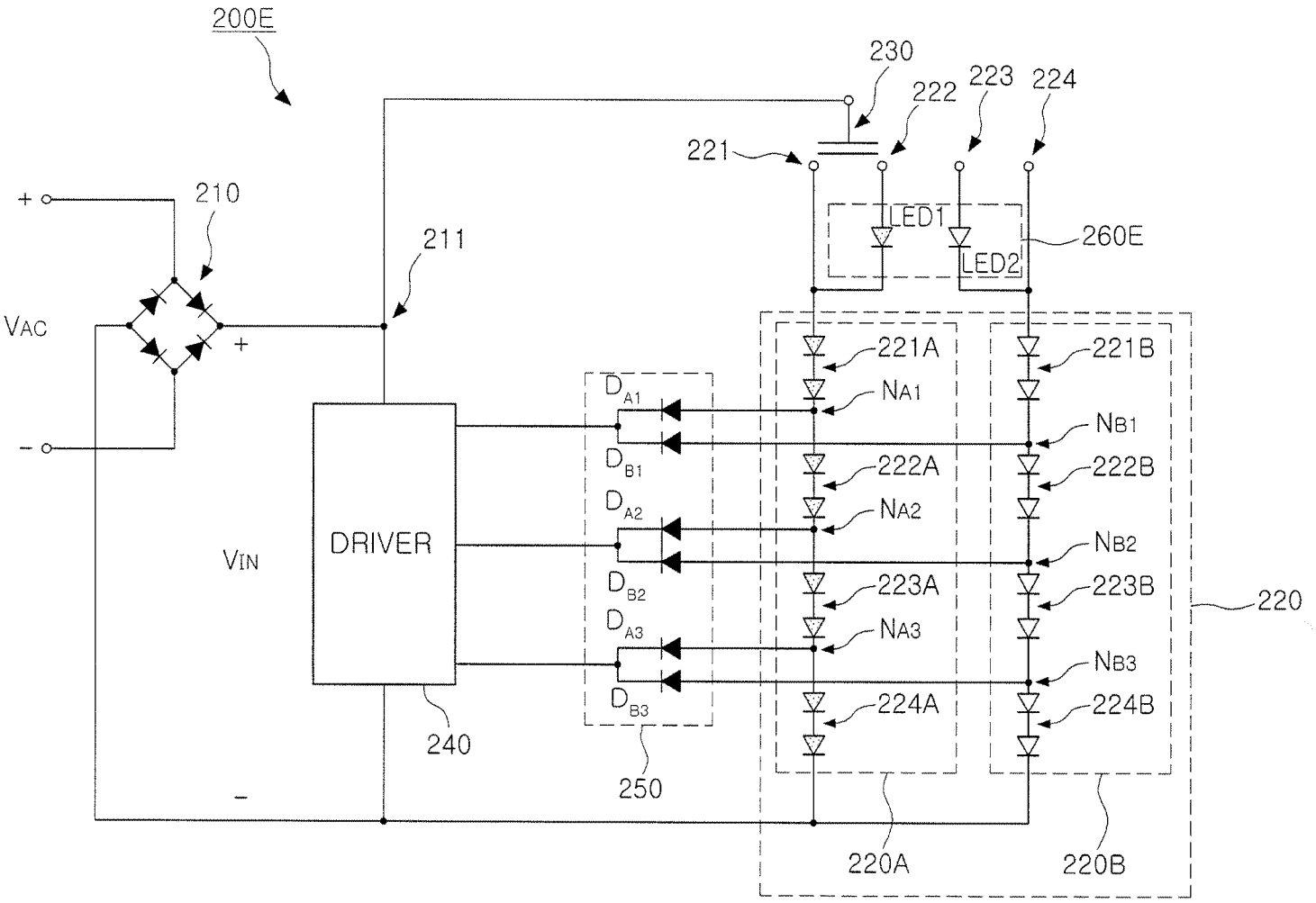

Next, referring to FIG. 14, a balance circuit 260E may include a first light emitting diode LED1 and a second light emitting diode LED2. The first light emitting diode LED1 may be connected between the second input node 222 and the first light emitting area 220A, and the second light emitting diode LED2 may be connected between the third input node 223 and the second light emitting area 220B.

In an example embodiment of FIG. 14, when the user adjust a color temperature of light emitted by the light emitting area 220 as a desired value between the first color temperature and the second color temperature, the lighting apparatus 200E can provide the light having a color temperature of the desired value, accurately. When the user control the color temperature controller 230 to connect the output node 211 to the second input node 222 and the third input node 223, the lighting apparatus 200E may output the light having a color temperature corresponding to an intermediate value between the first color temperature and the second color temperature. The first light emitting diode LED 1 and the second light emitting diode LED2 may emit light of the same color temperature as the light emitting diodes included in the first light emitting area 220A and the second light emitting area 220B, respectively. If necessary, the number of the first light emitting diodes LED1 and the number of the second light emitting diodes LED2 may be varied so that the first light emitting area 220A and the second light emitting area 220B can output the light having same brightness, when the output node 211 is connected with the second input node 222 and the third input node 223.

Figure 15:
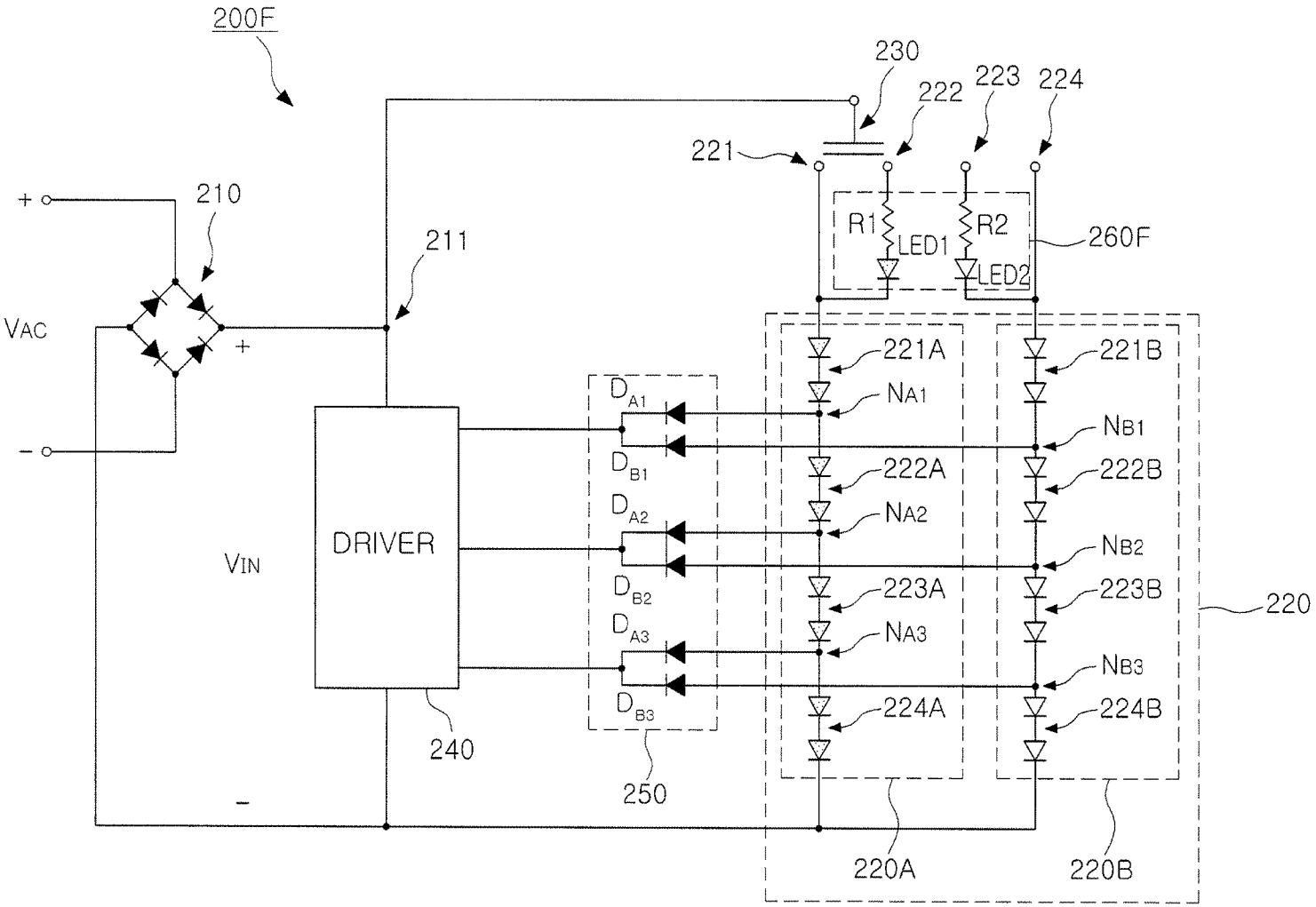

Next, referring to FIG. 15, a balance circuit 260F may include a first resistor R1, a second resistor R2, a first light emitting diode LED1, and the second light emitting diode LED2. The first resistor R1 and the first light emitting diode LED1 may be connected to each other in series, between the second input node 222 and the first light emitting area 220A. The second resistor R2 and the second light emitting diode LED2 may be connected to each other in series, between the third input node 223 and the second light emitting area 220B. The elements R1, R2, LED1, and LED2 included in the balance circuit 260F may be elements for adjusting the color temperature of the light emitting area 220 to an intermediated value between the first color temperature and the second color temperature, when the output node 211 is connected to the second input node 222 and the third input node 223 by the color temperature controller 230. The number of the first light emitting diode LED1 and the number of the second light emitting diode LED2 may be changed, similarly to an example embodiment described with reference to FIG. 14.

Figure 16:
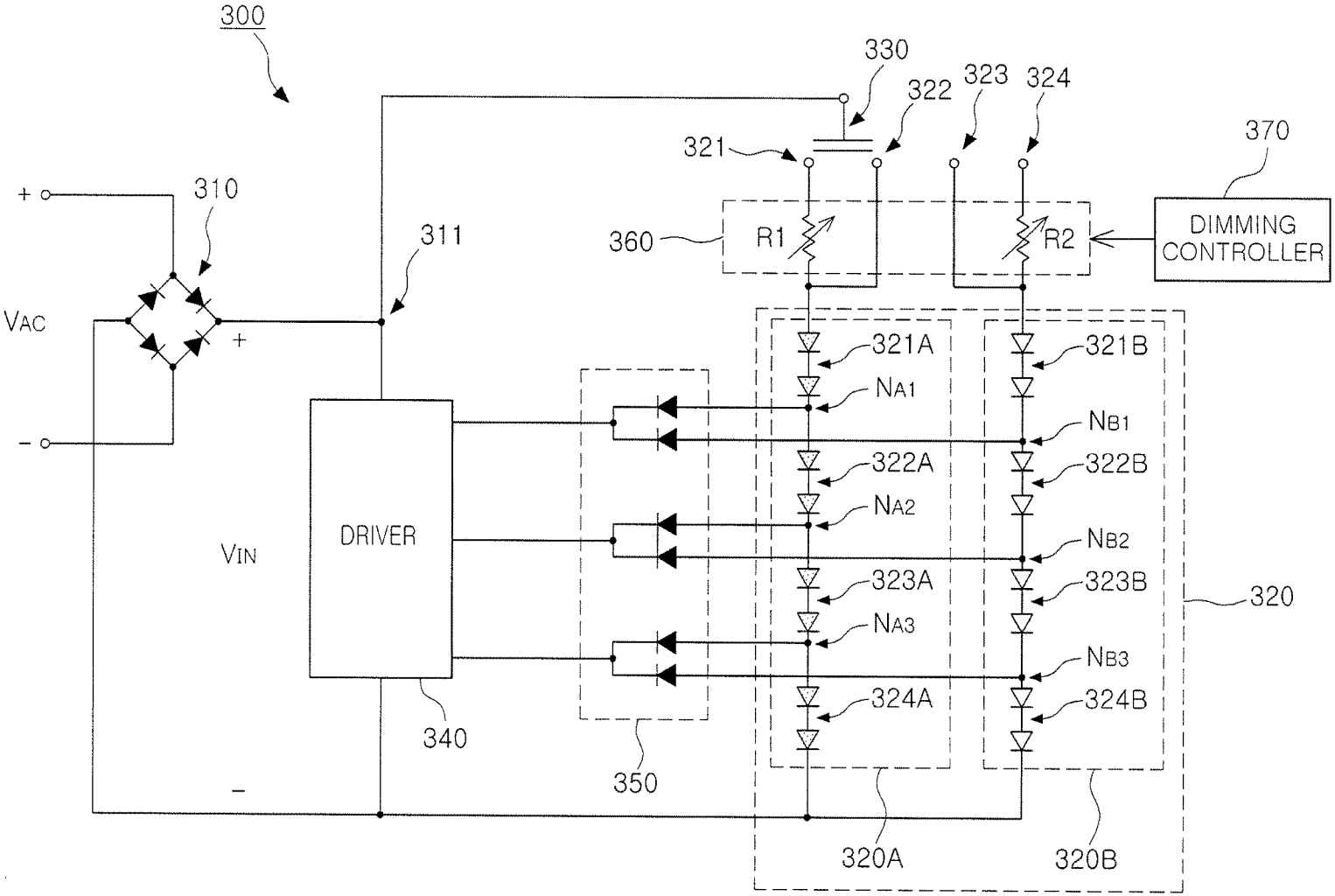
FIG. 16 illustrates another circuit embodiment of a lighting apparatus.

FIG. 16 illustrates another circuit embodiment of a lighting apparatus 300 which may include a power supply 310, a light emitting area 320, a color temperature controller 330, a driver 340, a block diode 350, a balance circuit 360, and a dimming controller 370.

Operation of the power supply 310, the light emitting area 320, the color temperature controller 330, the driver 340, and the block diode 350 may be similar to other example embodiments described previously. For example, a first light emitting area 320A in the light emitting area 320 may output light of a first color temperature, and a second light emitting area 320B may output light of a second color temperature higher than the first color temperature.

In an example embodiment illustrated in FIG. 16, the balance circuit 360 may include the first resistor R1 connected to the first light emitting area 320A and the second resistor R2 connected to the second light emitting area 320B. The first resistor R1 and the second resistor R2 may be, for example, a variable resistor. A user may adjust the resistance value of each of the first resistor R1 and the second resistor R2 through the dimming controller 370.

When the color temperature controller 330 allows a first input node 321 and a second input node 322 to be connected to an output node 311 of the power supply 310, only the first light emitting area 320A is turned on. As a result, light of a first color temperature may be output. When a user adjusts a resistance value of the first resistor R1 using the dimming controller 370, brightness of light having a first color temperature output by the first light emitting area 320A may be adjusted.

When the color temperature controller 330 allows a third input node 323 and a fourth input node 324 to be connected to the output node 311 of the power supply 310, only the second light emitting area 320B is turned on. As a result, light having a second color temperature may be output. When a user adjusts a resistance value of the second resistor R2 using the dimming controller 370, brightness of light of a second color temperature output by the second light emitting area 320B may be adjusted.

When the color temperature controller 330 allows the second input node 322 and the third input node 323 to be connected to the output node 311 of the power supply 310, the first light emitting area 320A and the second light emitting area 320B may be turned on simultaneously. When a user adjusts the resistance values of the first resistor R1 and the second resistor R2 using the dimming controller 370, brightness and color temperature of light output by the light emitting area 320 may be adjusted. In this case, the dimming controller 370 may serve as a user device for independently adjusting a resistance value of each of the first resistor R1 and the second resistor R2.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods herein.

The controllers, drivers, balancing circuits, switch elements, and other signal generating, signal providing, and signal processing features of the embodiments disclosed herein may be implemented in non-transitory logic which, for example, may include hardware, software, or both. When implemented at least partially in hardware, the controllers, drivers, balancing circuits, switch elements, and other signal generating, signal providing, and signal processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the controllers, drivers, balancing circuits, switch elements, and other signal generating, signal providing, and signal processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

In accordance with one or more example embodiments, the color temperature of light output by a lighting apparatus may be changed using a first light emitting area and a second light emitting area. The first and second light emitting areas may have light emitting elements that output light of different color temperatures. A color temperature controller may be connected to input nodes of the first light emitting area and the second light emitting area. In addition, a balance circuit may be included for compensating a difference in light output, generated when the same driving power is input to each of the first light emitting area and the second light emitting area. Thus, when a user changes the color temperature, a problem in which brightness of a lighting apparatus is changed together regardless of intention of the user may be solved.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, various changes in form and details may be made without departing from the spirit and scope of the embodiments set forth in the claims.

What is claimed is:

1. A lighting apparatus, comprising:

a first light emitting area including a plurality of first light-emitting arrays connected in series, the plurality of first light-emitting arrays to output light of a first color temperature;

a second light emitting area including a plurality of second light-emitting arrays connected in series and connected to the first light emitting area in parallel, the plurality of second light-emitting arrays to output light of a second color temperature different from the first color temperature;

a color temperature controller to be selectively connected to at least one of an input node of the first light emitting area and an input node of the second light emitting area, the color temperature controller to determine an on/off state of the first light emitting area and the second light emitting area; and a balance circuit connected to at least one of the first light emitting area and the second light emitting area in series and including a light emitting diode outputting a light having the first color temperature or the second color temperature.

2. The lighting apparatus as claimed in claim 1, wherein the first color temperature is lower than the second color temperature.

3. The lighting apparatus as claimed in claim 2, wherein the balance circuit is only connected between the second light emitting area and the color temperature controller.

4. The lighting apparatus as claimed in claim 1, further comprising:

a power supply to receive alternating current (AC) power and to supply driving power to the first light emitting area and the second light emitting area.

5. The lighting apparatus as claimed in claim 4, wherein the color temperature controller includes a switch to connect at least one of an input node of the first light emitting area and an input node of the second light emitting area to an output node of the power supply.

6. The lighting apparatus as claimed in claim 1, wherein:

the input node of the first light emitting area includes a first input node and a second input node, and the input node of the second light emitting area includes a third input node and a fourth input node.

7. The lighting apparatus as claimed in claim 6, wherein the balance circuit includes:

a first balance circuit connected between the second input node and the first light emitting area, and a second balance circuit connected between the third input node and the second light emitting area.

8. The lighting apparatus as claimed in claim 7, wherein the first balance circuit and the second balance circuit have different impedance values.

9. The lighting apparatus as claimed in claim 7, wherein:

the first color temperature is lower than the second color temperature, and the first balance circuit has an impedance value greater than that of the second balance circuit.

10. The lighting apparatus as claimed in claim 1, further comprising:

a driver to control an on/off state of each of the plurality of first light-emitting arrays and the plurality of second light-emitting arrays; and a block of diodes connected to a node between the first light-emitting arrays and a node between the second light-emitting arrays, the block of diodes to block current so that the current does not flow from the driver to the first light emitting area and the second light emitting area.

11. The lighting apparatus as claimed in claim 10, wherein:

the block of diodes includes a first block of diodes connected to a node between the first light-emitting arrays and a second block of diodes connected to a node between the second light-emitting arrays, and the first block of diodes and the second block of diodes are connected to each other in parallel.

12. The lighting apparatus as claimed in claim 11, wherein the driver is to determine a number of light-emitting arrays having been turned-on among the plurality of first light-emitting arrays and the plurality of second light-emitting arrays depending on a magnitude of driving power input to the first light emitting area and the second light emitting area.

13. The lighting apparatus as claimed in claim 1, wherein the balance circuit further includes at least one of a resistor and a diode connected between the light emitting diode and at least one of the first light emitting area and the second light emitting area.

14. The lighting apparatus as claimed in claim 1, wherein the color temperature controller is to determine a color temperature of light output by the first light emitting area and the second light emitting area between the first color temperature and the second color temperature.

15. A lighting apparatus, comprising:

a substrate;

a first light emitting area including a plurality of first LEDs mounted on the substrate;

a second light emitting area including a plurality of second LEDs mounted on the substrate, the plurality of second LEDs to output light of a color temperature higher than that of the plurality of first LEDs;

a color temperature controller including a user-operable switch, the color temperature controller to determine an on/off state of each of the first light emitting area and the second light emitting area by the switch; and a balance circuit connected between the second light emitting area and the color temperature controller and including a light emitting diode outputting a light having the first color temperature or the second color temperature.

16. The lighting apparatus as claimed in claim 15, further comprising:

a driver, mounted on the substrate, to determine an on/off state of the plurality of first LEDs and the plurality of second LEDs depending on a magnitude of driving power input to the first light emitting area and the second light emitting area.

17. The lighting apparatus as claimed in claim 16, wherein the driver and the balance circuit are in a single package.

18. The lighting apparatus as claimed in claim 15, wherein the balance circuit includes at least one of a resistor and a diode and has an adjustable impedance value.

19. The lighting apparatus as claimed in claim 18, wherein the balance circuit includes a device of adjusting of the impedance value of the balance circuit.

20. A lighting apparatus, comprising:

a first light emitting area including a plurality of first LEDs to output light of a first color temperature, the first light emitting area including a first input node and a second input node;

a second light emitting area including a plurality of second LEDs to output light of a second color temperature higher than the first color temperature, the second light emitting area including a third input node and a fourth input node;

a power supply to input driving power to at least a portion of nodes among the first input node through the fourth input node;

a switch to connect at least a portion of nodes among the first input node through the fourth input node to each other and to adjust a color temperature of light output by the first light emitting area and the second light emitting area, and a light emitting diode outputting light of the first color temperature or the second color temperature and connected to at least one of the first input node through the fourth input node.

* * * * *